United States Patent [19]

Herring

[11] 4,011,675

[45] Mar. 15, 1977

[54] REMOVABLE LICENSE PLATE HOLDER

[75] Inventor: Gerald L. Herring, Freeport, Ill.

[73] Assignee: Lawrence Peska Associates, Inc., New York, N.Y. ; a part interest

[22] Filed: Jan. 14, 1976

[21] Appl. No.: 648,866

[52] U.S. Cl. ..... 40/209
[51] Int. Cl.[2] ..... G09F 7/00
[58] Field of Search ..... 40/209, 129 C, 129 R, 40/200

[56] References Cited

UNITED STATES PATENTS

| | | | |
|---|---|---|---|
| 2,057,461 | 10/1936 | Walton | 40/209 X |
| 2,765,553 | 10/1956 | Audette | 40/209 |
| 2,831,280 | 4/1958 | McCulley | 40/209 X |

*Primary Examiner*—Louis G. Mancene
*Assistant Examiner*—John H. Wolff

[57] ABSTRACT

A removable license plate holder especially adapted for use where one plate is constantly being moved from one vehicle to another, such as automobile dealer demonstrator vehicles.

4 Claims, 3 Drawing Figures

FIG. 1
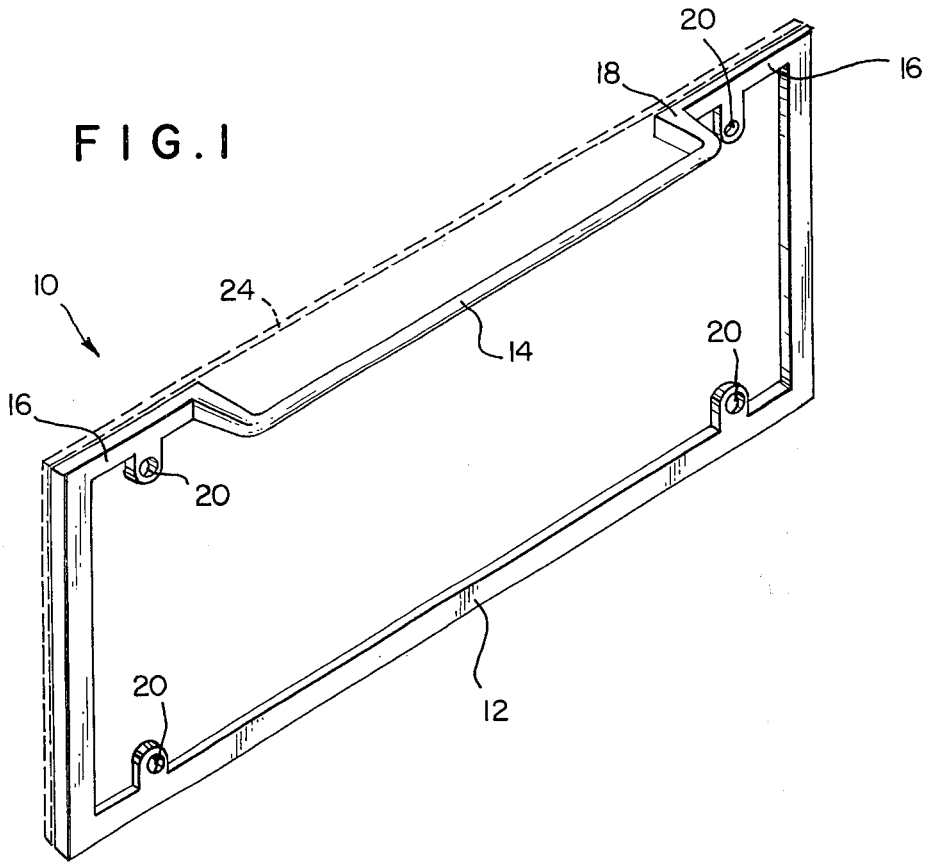
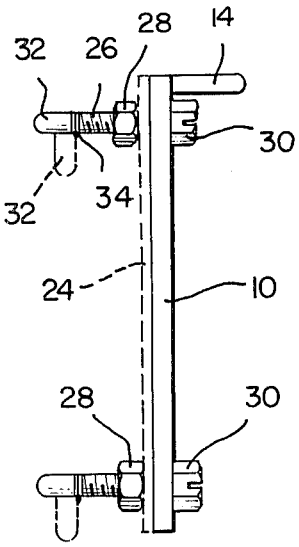
FIG. 2
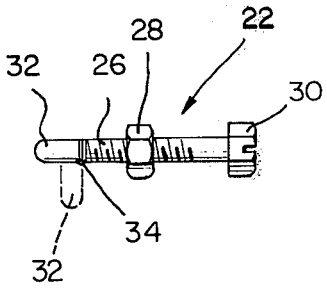
FIG. 3

REMOVABLE LICENSE PLATE HOLDER

BACKGROUND OF THE INVENTION

This invention relates to a removable license plate holder. More particularly, the invention relates to such a holder that may be quickly removed with the plate thereon.

The prior art teaches a variety of license plate holders, for example those disclosed in U.S. Pat. Nos. 2,121,677; 2,916,842; 3,263,358; 3,340,639; 3,340,640; 3,389,486; 3,439,440; 3,702,510; and others. The foregoing devices are deficient, however, in that they fail to provide for quick removal of the license plate itself without first removing the holder.

SUMMARY OF THE INVENTION

It is accordingly an object of the instant invention to provide for an improved license plate holder.

It is another object to avoid one or more drawbacks of the prior art.

It is a further object to provide for the same at relatively little cost thereby making it generally available.

These and other objects of the invention will become more apparent from the following detailed disclosure and claims and by reference to the accompanying drawings, in which:

FIG. 1 is a front elevational view of the device;

FIG. 2 is a side elevational view, partly in perspective; and

FIG. 3 is a side elevational view of the fastening means.

Broadly speaking, the instant invention includes the provision of a vehicle license plate holder adapted to receive and be affixed to a license plate and engage as a unit, a vehicle bumper, comprising a substantially rectangular frame means, one side of the frame defining a first member out of planar alignment with the balance of the frame, the first member having inleted portions adjacent each distal end thereof, a shoulder communicating between each inleted portion and the first member, the inleted portions being in planar alignment with the frame, a plurality of apertures defined on the frame means, means for affixing the frame to the bumper, the means including an externally threaded bolt and an internally threaded nut adapted to engage the bolt and the plate, pivot means disposed on a distal end of the bolt, a second member integral with the pivot means and adapted to pivot about the pivot means between a position in planar alignment with the bolt and a position substantially perpendicular thereto, the second member adapted to engage the vehicle power.

DETAILED DISCLOSURE

Referring more particularly to the drawings, there is shown a license plate holder 10 of the type which can be employed on most motor vehicles. The holder 10 includes a substantially rectangular frame 12 having four sides, one of which includes a handle portion 14 or a first member 14 that includes two distal end inleted members 16 which are out of planar alignment with the member 14 and which are separated by a shoulder 18 therefrom. Each inleted member 16 will preferably communicate with the shoulder 18 at an angle of at least 90°. The entire frame 10 assembly can be unitary if desired. There will preferably be disposed several, such as two to four apertures 20 on or adjacent the frame 10 that are adapted to receive the means 22 for affixing the same to the vehicle (not shown). The license plate 24 will be disposed between the frame 10 and the vehicle body, e.g., bumper.

The means 22 will be any suitable bolt 26 and nut means 28 that are adapted to engage each other in mating arrangement. The bolt 26 preferably has a slotted or polygonal head 30 and is externally threaded for at least a portion of its length to receive the internally threaded nut 28.

Integral with the shank portion of the bolt 26 and disposed on the distal end thereof opposite the head 30 there is disposed a member 32 that is pivotably mounted to the bolt 26 such as by suitable hinge means 34. The member 32 is adapted to pivot between a position in substantial planar alignment with the shank of the bolt 26 and a variety of positions substantially perpendicular thereto and inbetween.

The plate frame 10 is placed over the plate 24, the means 22 with the member aligned with the bolt 26 is passed through the aperture 20 whereupon the nut 28 is tightened about the bolt 26 to hold the plate 24 firmly against the frame 10, whereupon the distal end of the bolt 26 with the member 32 leading is engaged by an aperture (not shown) on the bumper and the member 32 is pivoted out of planar alignment with the bolt 26 such as by a bending action with the frame 10 whereby the entire assembly is held to the bumper. When the plate is needed for another vehicle the procedure is reversed and the same plate may be employed with its frame 10 without the necessity of removing it therefrom or unscrewing the plate from the bumper.

Since it is obvious that numerous changes and modifications can be made in the above-described details without departing from the spirit and nature of the invention, it is to be understood that all such changes and modifications are included within the scope of the invention.

I claim:

1. A vehicle license plate holder adapted to receive and be affixed to a license plate and as a unit engage therewith a vehicle bumper having first apertures therein comprising a substantially rectangular frame means, one side of said frame defining a first member out of planar alignment with the balance of said frame, said first member having inleted portions adjacent each distal end thereof, a shoulder communicating between each inleted portion and said first member, said inleted portions being in planar alignment with said frame, a plurality of second apertures defined on said frame means and being axially alignable with said first apertures, means for affixing said frame to said vehicle bumper through said first and second apertures, said means including an externally threaded bolt and an internally threaded nut adapted to engage said bolt and said plate, pivot means disposed on a distal end of said bolt, a second member integral with said pivot means and adapted to pivot about said pivot means between a position in planar alignment with said bolt and a position substantially perpendicular thereto, said second member adapted to engage said vehicle bumper through said first apertures.

2. The holder as defined in claim 1 wherein said pivot means is a hinge.

3. The holder as defined in claim 1 wherein said frame includes a plurality of sections out of one of the planes of said frame, said sections defining said second apertures.

4. The holder as defined in claim 1 wherein said frame is constructed of a material having a non-ferrous outer surface.

* * * * *